United States Patent [19]

Sheehan

[11] 3,959,035

[45] May 25, 1976

[54] HEAT TREATMENT FOR MINIMIZING CRAZING OF HOT-DIP ALUMINUM COATINGS

[75] Inventor: John M. Sheehan, Penn Hills Township, Allegheny County, Pa.

[73] Assignee: United States Steel Corporation, Pittsburgh, Pa.

[22] Filed: Oct. 9, 1973

[21] Appl. No.: 404,841

[52] U.S. Cl. ..... 148/134; 427/383; 427/431; 427/436; 148/156; 427/380; 427/399; 427/320; 427/329

[51] Int. Cl.[2] ..... B44D 1/092; C23C 1/08

[58] Field of Search ..... 117/62, 131, 51; 148/134

[56] References Cited

UNITED STATES PATENTS

| | | | |
|---|---|---|---|
| 1,982,563 | 11/1934 | Wimmer | 117/131 |
| 2,082,622 | 6/1937 | Fink | 117/131 |
| 2,453,772 | 11/1948 | Whitfield | 117/131 |
| 3,033,705 | 5/1962 | Hanink et al. | 117/131 |
| 3,318,126 | 5/1967 | Werthman | 72/39 |

*Primary Examiner*—William D. Martin
*Assistant Examiner*—Janyce A. Bell
*Attorney, Agent, or Firm*—Arthur J. Greif

[57] ABSTRACT

The crazing resistance of hot-dip aluminum coatings is enhanced by heat-treating the coated strip at a temperature of about 500° – 1000°F for a period of at least 10 minutes. At the lower end of the temperature range, a period substantially in excess of 5 hours is required. Tnis heat treatment may be effected by retarding the cooling of the coated strip after its emergence from the molten aluminum bath, or the strip may first be cooled as in conventional practice and then reheated to the requisite temperature range.

4 Claims, No Drawings

HEAT TREATMENT FOR MINIMIZING CRAZING OF HOT-DIP ALUMINUM COATINGS

This invention relates to a method for the production of a hot-dipped, aluminum coated, ferrous strip product with a decreased tendency to crazing of the coating.

Hot-dipped aluminum coated ferrous strip (the term "strip" will be employed herein to generically define elongated flat rolled articles, such as sheet product) is regularly produced in two coating-thickness classifications, designated as "Type 1" and "Type 2" product. Type 1 strip has a nominal 1-mil thick coating on each side of the ferrous strip, while Type 2 strip has a nominal 2-mil thick coating on each side. Molten aluminum baths of varying composition may be employed. However, when adherence and formability of the coating is of paramount importance, the art generally employs a bath containing about 4 to 12% Si to retard the rate of alloying between the bath metal and the ferrous strip. These baths also contain from about 0.1 to 3.0 percent iron, picked up primarily by the reaction of the bath with the ferrous strip and the bath rigging. The resultant coating consists of a thin, interfacial alloy layer and an overlying layer composed of discrete particles of silicon and intermetallic alloy phases in an aluminum matrix. Virtually all such aluminum coatings exhibit a tendency to craze, i.e., to form fine cracks on the tension side, whenever the strip is formed with sharp radii. During subsequent exposure to oxidizing atmospheres, an iron-rust stain quickly develops within these cracks, because the steel is anodic to the coating. Although the corrosion product fills the cracks and thereby prevents further attack on the steel base, the resultant stain is considered objectionable from an appearance standpoint.

It is therefore a prime object of this invention to provide an economical method for minimizing the crazing tendency of hot-dip aluminum coatings.

The mill treatment of ferrous strip prior to hot-dip aluminizing is generally similar to the procedure employed in hot-dip galvanizing. Although cut lengths of strip may be coated in what may be termed a batch operation, substantially all such coatings are now produced on continuous, anneal-in-line equipment. Whether batch or continuous-in-line, the coating process consists of three basic operations: surface cleaning, heat-treatment of the steel strip and then hot-dip aluminizing. In some continuous-in-line processes, the heat-treatment step effects cleaning as well. Thus, in one well known process, the cold-reduced strip is first passed to an open-flame oxidizing furnace, which also serves as a flame degreaser and then to a reducing furnace where the resultant oxide film is reduced, and the strip is annealed or normalized. The strip is then cooled in the exit zone of the reducing furnace to about the temperature of the coating bath and then passed into the bath, through a conduit extending slightly below the surface of the bath. Another widely used continuous-in-line process is also based on the use of a reducing atmosphere, but without preliminary oxidation. In this latter process, the strip is alkaline cleaned, rinsed and dried, bright annealed, cooled to slightly above bath temperature and introduced into the bath while still protected by the furnace atmosphere. The temperatures employed in such furnaces are generally dependent on the mechanical properties and formability that are desired for the specific product. In those instances where a hard product is desired, the strip is merely preheated to a temperature of about 1000°F. In most instances, however, a substantially fully recrystallized product is desired and the strip is therefore subcritically annealed at temperatures of about 1300°F or normalized at temperatures up to about 1,750°F.

It has now been found that the resistance to crazing of the coating can be substantially enhanced if subsequent to coating, the aluminum coated strip is given a post heat-treatment at temperatures between 500° and 1,000°F. When temperatures within the lower end of the range (e.g. 500° – 600°F) are employed, heat-treating periods substantially in excess of 5 hours are required. At the higher temperatures in the prescribed range, heat-treating times as short as about ten minutes may be satisfactory. Post heat-treatment temperatures in excess of about 1000°F are generally less desirable due to the possibility that the interfacial alloy layer will grow excessively and thereby embrittle the coating. By post heat treating within the prescribed temperature range, the thickness of the interfacial alloy layer, as determined by metallographic measurements and by analyses of the iron content of the coating, was not significantly changed (except for long times at 1000°F).

The prescribed post heat-treatment can be performed, for example, by retarding the cooling of the strip after coating with aluminum, or by an inexpensive post-coating box anneal. It was found, however, that post heat-treatment times of from 30 to 87 seconds were ineffective in decreasing crazing tendency. Therefore, in view of the minimum time requirements for such post heat treatments, continuous in-line processes cannot practically be effected through the sole utilization of a short furnace immediately following the coating bath (i.e., in a manner analogous to that of the galvannealing of zinc coatings). However, crazing tendency can be reduced by various means, e.g. a sufficiently long furnace, for retarding the cooling rate to the requisite extent.

To illustrate the benefit of the post heat-treatment on crazing tendency, forming tests were conducted on six different lots (Table 1 below) of aluminum-coated strip that contained from 6.9 to 8.0% Si in the coating.

Table I

| Sample Identification | Sheet Thickness, inch | Coating Weight, oz/sq ft |
|---|---|---|
| A | 0.028 | 1.01 |
| B | 0.031 | 0.74 |
| C | 0.032 | 0.68 |
| D | 0.022 | 1.23 |
| E | 0.021 | 0.66 |
| F | 0.028 | 1.36 |

Crazing resistance was determined using the controlled bend sample described in ASTM Spec. A525-71. The test employed consisted of forming a sample of the strip in a flat bend (0T), followed successively by a bend over one sheet thickness (1T), then a bend over two sheets thicknesses (2T), etc., each bend being less severe than the preceding bend. The degree of crazing at each bend was then observed at 30 diameters magnification and rated as "heavy", "medium", "light" or "none". For a particular sample, the test was stopped when the rating of "none" was obtained.

The results of the forming tests on post heat-treated samples and on control samples (not post heat-treated) are shown in Table II.

Table II

Crazing-Tendency Ratings of Heat-Treated Samples

| Sample Identification | Heat-Treating Conditions Temp., °F | Time, minutes | Number of Sheet Thicknesses Over Which Sample Was Bent to First Obtain Indicated Rating: Light | None |
|---|---|---|---|---|
| A | Not heat-treated | | 5 | 7 |
| | 500 | 10 | 5 | 7 |
| | | 60 | 5 | 7 |
| | | 300 | 4 | 5 |
| | | 1440 | 5 | 7 |
| | 600 | 10 | 3 | 5 |
| | | 60 | 4 | 7 |
| | | 300 | 2 | 5 |
| | | 1440 | 3 | 5 |
| | 700 | 10 | 3 | 5 |
| | | 60 | 5 | 6 |
| | | 300 | 3 | 5 |
| | | 1440 | 2 | 3 |
| | 800 | 10 | 2 | 4 |
| | | 30 | 1 | 2 |
| | | 45 | 2 | 4 |
| | | 60 | 1 | 2 |
| | | 180 | 0 | 2 |
| | | 300 | 2 | 4 |
| | | 1440 | 0 | 1 |
| | 900 | 10 | 3 | 5 |
| | | 60 | 3 | 5 |
| | | 300 | 0 | 1 |
| | | 1440 | 2 | 5 |
| | 1000 | 10 | 2 | 4 |
| | | 60 | 2 | 4 |
| | | 300 | 0 | 2 |
| | | 1440 | 2 | 3 |
| | 1100 | 10 | * | * |
| | | 60 | * | * |
| | | 300 | * | * |
| B | Not heat-treated | | 5 | 8 |
| | 500 | 1440 | 2 | 6 |
| | 600 | 1440 | 0 | 2 |
| | 700 | 1440 | 0 | 2 |
| | 800 | 1440 | 0 | 1 |
| | 900 | 300 | 1 | 2 |
| | | 1440 | 0 | 2 |
| | 1000 | 300 | * | * |
| | | 1440 | * | * |
| C | Not heat-treated | | 5 | 7 |
| | 500 | 1440 | 2 | 5 |
| | 600 | 1440 | 2 | 3 |
| | 700 | 1440 | 0 | 4 |
| | 800 | 1440 | 0 | 2 |
| | 900 | 300 | 0 | 2 |
| | | 1440 | 1 | 2 |
| | 1000 | 300 | * | * |
| | | 1440 | * | * |
| D | Not heat-treated | | 8 | 9 |
| | 900 | 300 | 3 | 4 |
| | 1000 | 300 | 3 | 5 |
| E | Not heat-treated | | 3 | 8 |
| | 900 | 300 | — | 0 |
| | 1000 | 300 | — | 0 |
| F | Not heat-treated | | 6 | 13 |
| | 900 | 300 | 2 | 5 |
| | 1000 | 300 | * | * |

*On these samples, there was excessive growth (i.e., evidenced by the embrittlement of the coating) of the interfacial alloy layer through to the surface of the sheet.

In the above rating system, the numbers refer to the mildness of the bend at which both light crazing and no crazing were first obtained. Thus, for example, if the number in the rating under "light" is 3 and under "none" is 5; the sample first exhibited light crazing for the 3T bend and first exhibited no crazing for the milder 5T bend. It may be seen from the above, that crazing was not eliminated on the control samples until the bends were relatively mild (7T to 13T bends). Post heat-treating at 500°F for 24 hours provided some benefit (for samples B & C). Post heat treatments in the range 600° – 900°F provided a more significant benefit. Thus, many samples treated in this latter temperature range exhibited no crazing even with severe bends (0T to 2T). Heat treatments at 1000°F for short periods improved crazing resistance, but long time heat-treatments at this temperature sometimes caused excessive interfacial alloy growth and were therefore unsatisfactory on that account.

I claim:

1. In the method for the production of aluminum-coated ferrous product, wherein cold reduced base strip is heated to a temperature within the range of about 1300° – 1750°F and maintained within that temperature range for a time sufficient to substantially recrystallize said base strip and is thereafter passed through a bath of molten aluminum containing from about 4 to 12 percent Si and from about 0.1 to about 3.0 percent Fe and the resultant aluminum coated strip is cooled to yield a coating comprised of a relatively thin interfacial alloy layer and an overlying layer composed of discrete alloy phases in an aluminum matrix, the improvement which comprises, post heat treating the coated strip at a temperature of about 500° to 1000°F, for a period greater than 10 minutes, wherein the period employed is at least sufficient to materially reduce the crazing tendency of said coating but less than at which the growth of said interfacial alloy layer becomes excessive.

2. The method of claim 1, wherein said post heat treating temperature is about 600° to 900°F and said period is less than 24 hours.

3. The method of claim 1, wherein said post heat treating is accomplished by retarding the cooling of the coated strip after its emergence from the coating bath.

4. The method of claim 2, wherein the strip emerging from said coating bath is initially cooled to about room temperature and is subsequently reheated to said temperature of about 600° to 900°F.

* * * * *